US006737005B1

(12) United States Patent
Rosenberg et al.

(10) Patent No.: US 6,737,005 B1
(45) Date of Patent: May 18, 2004

(54) METHOD OF PRODUCING SOLID DOSAGE FORMS

(75) Inventors: Jörg Rosenberg, Ellerstadt (DE); Werner Maier, Schifferstadt (DE)

(73) Assignee: Abbott GmbH & Co. KG (DE)

( * ) Notice: Subject to any disclaimer, the term of this patent is extended or adjusted under 35 U.S.C. 154(b) by 0 days.

(21) Appl. No.: 09/831,397

(22) PCT Filed: Nov. 22, 1999

(86) PCT No.: PCT/EP99/08995

§ 371 (c)(1),
(2), (4) Date: May 9, 2001

(87) PCT Pub. No.: WO00/30586

PCT Pub. Date: Jun. 2, 2000

(30) Foreign Application Priority Data

Nov. 23, 1998 (DE) ..... 198 53 985

(51) Int. Cl.[7] ..... B26B 1/02
(52) U.S. Cl. ..... 264/141; 264/310; 425/363
(58) Field of Search ..... 264/141, 310, 264/300, 299, 112; 425/363

(56) References Cited

U.S. PATENT DOCUMENTS 3,890,080 A * 6/1975 Cotts ..... 425/363
4,801,460 A * 1/1989 Goertz et al. ..... 514/772.5
4,880,585 A 11/1989 Klimesch et al. ..... 264/141
5,049,333 A * 9/1991 Wolfe et al. ..... 264/109
5,073,379 A * 12/1991 Klimesch et al. ..... 424/467
6,009,690 A 1/2000 Rosenberg et al. ..... 53/454
6,284,803 B1 * 9/2001 Kothrade et al. ..... 514/772.1
6,350,398 B1 * 2/2002 Breitenbach et al. ..... 264/129
6,423,256 B1 * 7/2002 Kothrade et al. ..... 264/122
6,528,089 B1 * 3/2003 Kothrade et al. ..... 424/464
2001/0001670 A1 * 5/2001 Krismanth et al. ..... 425/237

FOREIGN PATENT DOCUMENTS

WO WO 97/36722 10/1997

OTHER PUBLICATIONS

Pietsch et al. Die Bedeutung der Walzenkonstruktion von Brikettier–, Kompaktier–und Pelletiermaschinen für ihre technische Anwendung*) Aufbereitungs–Technik No. 3, (1970) pp. 128–138.

* cited by examiner

*Primary Examiner*—Mary Lynn Theisen
(74) *Attorney, Agent, or Firm*—Keil & Weinkauf

(57) ABSTRACT

A process for producing solid dosage forms by a) producing a plastic mixture which comprises at least one active ingredient and at least one polymeric binder, and b) shaping the plastic mixture to the solid dosage forms in a molding calender with two counterrotating molding rolls, wherein one molding roll has at least one annular groove running along its periphery and the other molding roll has at least one ring, running along its periphery, of teeth extending radially outward and able to engage in the annular groove is described.

7 Claims, 3 Drawing Sheets

METHOD OF PRODUCING SOLID DOSAGE FORMS

The present invention relates to a process for producing solid dosage forms by producing a plastic mixture which comprises at least one active ingredient and at least one polymeric binder, and shaping the plastic mixture to the solid dosage forms in a molding calender with two counterrotating forming rolls.

A process of this type is disclosed, for example, in U.S. Pat. No. 4,880,585. In this process, a composition containing active ingredient and binder is plasticized using an extruder, and the resulting melt is subjected to a shaping in a molding calender. The molding rolls of the molding calender have on their surface depressions with mutually corresponding outlines. The depressions on the surfaces of the molding rolls briefly meet at the contact line of the molding rolls to form molds for the active ingredient-containing melt and then, as rotation of the molding rolls continues, diverge again to release the molded dosage forms. This process has certain disadvantages. Thus, the depressions on the surface of the molding rolls must exactly coincide with their outlines during the shaping of the plastic mixture in order to achieve complete closure of the mold. Even tiny relative displacements of the depressions, e.g. in the region of a few micrometers, immediately lead to a detectable mismatch of the upper side and lower side of the dosage form. On the one hand this requires high precision in producing the molding rolls and, on the other, there must be exactly synchronous movement of the molding rolls in the calender toward one another. This is possible only with elaborately designed machinery. The production of the molding rolls is complicated and costly because cavities with a three-dimensional structure must be provided in the roll surfaces. This particularly applies when more complicated geometries, e.g. divisible tablets with a score are desired. Because of the need for the two molding rolls to be accurately aligned in the known molding calendering processes, no segmentation of the molding rolls into individual roll disks which each comprise only one or a few lanes of depressions, and can be combined to a multilane roll as required, is possible because the individual segments easily become twisted due to the molding pressure occurring during the calendering. However, this twisting leads to the upper and lower halves of the tablet molds not being exactly coincident on rotation. Segmentation of the molding rolls is, however, desirable in order for it to be necessary, for example if individual cavities are damaged, to replace only one roll disk and not the entire roll, or for it to be possible to combine diverse molds in one roll as desired.

It has already been proposed to combine a molding roll having depressions on its surface with a second roll which contains no depressions (smooth roll). In this case there is no need for accurate alignment of the two rolls. However, the disadvantage in this case is that elaborate production of at least one of the two rolls is still necessary. In addition, there are very limited possibilities for the shape of the tablet molds with this combination.

It is an object of the present invention to provide a simple and cost-effective process for producing solid dosage forms in which no problems relating to mismatch of upper and lower halves of the dosage forms occur.

We have found that this object is achieved when the molding rolls are designed on their surface so that they are able to intermesh.

The present invention therefore relates to a process for producing solid dosage forms by a) producing a plastic mixture which comprises at least one active ingredient and at least one polymeric binder, and b) shaping the plastic mixture to the solid dosage forms in a molding calender with two counterrotating molding rolls, wherein one molding roll has at least one annular groove running along its periphery and the other molding roll has at least one ring, running along its periphery, of teeth extending radially outward and able to engage in the annular groove. The teeth are shaped so that, on maximum engagement in the annular groove, they essentially completely fill the cross-section of the annular groove, i.e. the annular groove and the teeth are essentially complementary in cross-section profile.

The intermeshing of the molding rolls makes it unnecessary to align the two individual rolls accurately, because only one roll of the pair of rolls has an angle-dependent surface structure. It is therefore possible to select considerably simpler designs of machinery for the calenders accomodating the molding rolls.

Molding rolls to be used according to the invention are known as "prism rolls" from compaction technology. In this connection, reference is made to B. Pietsch, Aufbereitungs-Technik 3 (1970) pp. 128–138. The use of such rolls for compacting free-flowing materials to granules is described therein. Problems of a possible mismatch between upper and lower half of the compacts formed are not mentioned in this connection.

Pairs of rolls to be used according to the invention make it possible, despite the simple design of the rolls, for the solid dosage forms produced in this way to have a considerable variety of shapes. The possible variations relate primarily to the design of the annular groove and the design of the interstice between consecutive teeth in a ring. Thus, the annular groove may have a series of different cross-section profiles (projection onto a plane containing the axis of the roll). The annular groove may have a rectangular, triangular, rounded or any other cross-section. It is generally preferred for the annular groove to have a rounded cross-section profile for easier demolding of the shaped dosage forms.

The longitudinal profile of the interstices between consecutive teeth in a ring (i.e. the projection of the interstice onto a plane perpendicular to the axis of the roll) is likewise subject to variation. Thus, the interstices may have triangular, parallelogram-shaped, rounded or another longitudinal profile. However, it is generally preferred for the interstices between consecutive teeth in a ring to have a rounded longitudinal profile.

The resulting dosage forms may have in this way, for example, a prism shape, truncated prism shape, tetrahedral shape or saddle shape, and the saddle shape is preferred.

In a preferred embodiment of the process according to the invention, a circulating bar is present on the base of the annular groove and the teeth have a corresponding recess. It is possible in this way to produce divisible tablets having a score on one side of their surface.

It is likewise possible for a bar which does not extend up to the outer surface of the roll to be present between consecutive teeth in a ring. It is likewise possible in this way to produce divisible tablets with a score.

In order to facilitate demolding of the formed dosage forms from the annular groove and the interstices between the teeth, it is possible to keep the contact pressure between the two molding rolls low, or to provide a small spacing between the molding rolls, e.g. 0.1–1 mm. This results in a "tablet ribbon" in which the individual dosage forms are still connected together by narrow flashes. The individual dosage forms can, especially when the plastic mixture shows increased brittleness after complete cooling, easily be separated from one another. It may be appropriate then to deflash the resulting dosage forms.

After the molding process, the drug forms are allowed to cool and solidify, e.g. on a cooling belt.

The present process for producing solid dosage forms comprises the production of a plastic mixture. This usually takes place by mixing and melting at least one pharmacologically acceptable polymeric binder, at least one active pharmaceutical ingredient and, where appropriate, conventional pharmaceutical additives in the presence or absence of a solvent. These process steps can be carried out in known manner.

The components can first be mixed and then be melted and homogenized. However, it has proven to be preferred, especially on use of sensitive active ingredients, first for the polymeric binder to be melted and premixed where appropriate together with conventional pharmaceutical additives, operating the stirred vessels, agitators, solids mixers etc. where appropriate alternately, and then for the sensitive active ingredient(s) to be mixed in (homogenization) in "intensive mixers" in the plastic phase with very short residence times. The active ingredients) can be employed in solid form or as solution or dispersion.

The melting and mixing take place in an apparatus customary for this purpose. Extruders or heatable containers with an agitator, e.g. kneaders (such as the type mentioned below), are particularly suitable.

It is also possible to use as mixing apparatus the devices employed for mixing in plastics technology. Suitable devices are described, for example, in "Mischen beim Herstellen und Verarbeiten von Kunststoffen", H. Pahl, VDI-Verlag, 1986. Particularly suitable mixing apparatuses are extruders and dynamic and static mixers, and stirred vessels, single-shaft stirrers with stripper mechanisms, especially paste mixers, multishaft stirrers, especially PDSM mixers, solids mixers and, preferably, mixer/kneader reactors (e.g. ORP, CRP, AP, DTB supplied by List or Reactotherm supplied by Krauss-Maffei or Ko-kneader supplied by Buss), trough mixers and internal mixers or rotor/stator systems (e.g. Dispax supplied by IKA).

In the case of sensitive active ingredients, it is preferable first for the polymeric binder to be melted in an extruder and then for the active ingredient to be admixed in a mixer/kneader reactor. On the other hand, with less sensitive active ingredients, a rotor/stator system can be employed for vigorously dispersing the active ingredient.

The mixing device is charged continuously or batchwise, depending on its design, in a conventional way. Powdered components can be introduced in a free feed, e.g. via a weigh feeder. Plastic compositions can be fed in directly from an extruder or via a gear pump, which is particularly advantageous if the viscosities and pressures are high. Liquid media can be metered in by a suitable pump unit.

The mixture obtained by mixing and melting the binder, the active ingredient and, where appropriate, the additive(s) ranges from pasty to viscous (thermoplastic) and is therefore extrudable. The glass transition temperature of the mixture is below the decomposition temperature of all the components present in the mixture. The binder should preferably be soluble or swellable in a physiological medium. Examples of suitable binders are:

polyvinylpyrrolidone (PVP), copolymers of N-vinylpyrrolidone (NVP) and vinyl esters, especially vinyl acetate, copolymers of vinyl acetate and crotonic acid, partially hydrolyzed polyvinyl acetate, polyvinyl alcohol, poly(hydroxyalkyl acrylates), poly (hydroxyalkyl methacrylates), polyacrylates and polymethacrylates (Eudragit types), copolymers of methyl methacrylate and acrylic acid, cellulose esters, cellulose ethers, especially methylcellulose and ethylcellulose, hydroxyalkylcelluloses, in particular hydroxypropylcellulose, hydroxyalkylalkylcelluloses, in particular hydroxypropylethylcellulose, cellulose phthalates, in particular cellulose acetate phthalate and hydroxypropylmethylcellulose phthalate, and mannans, especially galactomannans. The K values (according to H. Fikentscher, Cellulose-Chemie 13 (1932), pages 58–64, 71, 74) of the polymers are in the range from 10 to 100, preferably 12 to 70, in particular 12 to 35, for PVP>17, in particular 20 to 35.

Preferred polymeric binders are polyvinylpyrrolidone, copolymers of N-vinylpyrrolidone and vinyl esters, poly (hydroxyalkyl acrylates), poly(hydroxyalkyl methacrylates), polyacrylates, polymethacrylates, alkylcelluloses and hydroxyalkylcelluloses. The polymeric binder must soften or melt in the complete mixture of all the components in the range from 50 to 180° C., preferably 60 to 130° C. The glass transition temperature of the mixture must therefore be below 180° C., preferably below 130° C. If necessary, it is reduced by conventional pharmacologically acceptable plasticizing auxiliaries. The amount of plasticizer does not exceed 30% by weight, based on the total weight of binder and plasticizer, in order to form drug forms which are stable on storage and show no cold flow. However, the mixture preferably contains no plasticizer.

Examples of such plasticizers are:

long chain alcohols, ethylene glycol, propylene glycol, glycerol, trimethylolpropane, triethylene glycol, butanediols, pentanols such as pentaerythritol, hexanols, polyethylene glycols, polypropylene glycols, polyethylene/propylene glycols, silicones, aromatic carboxylic esters (e.g. dialkyl phthalates, trimellitic esters, benzoic esters, terephthalic esters) or aliphatic dicarboxylic esters (e.g. dialkyl adipates, sebacic esters, azelaic esters, citric and tartaric esters), fatty acid esters such as glycerol monoacetate, glycerol diacetate or glycerol triacetate or sodium diethyl sulfosuccinate. The concentration of plasticizer is generally from 0.5 to 15, preferably 0.5 to 5, % of the total weight of the mixture.

Conventional pharmaceutical auxiliaries, whose total amount can be up to 100% of the weight of the polymer, are, for example, extenders and bulking agents such as silicates or diatomaceous earth, magnesium oxide, aluminum oxide, titanium oxide, stearic acid or its salts, e.g. the magnesium or calcium salt, methylcellulose, sodium carboxymethylcellulose, talc, sucrose, lactose, cereal or corn starch, potato flour, polyvinyl alcohol, in particular in a concentration of from 0.02 to 50, preferably 0.20 to 20, % of the total weight of the mixture.

Lubricants such as aluminum and calcium stearates, talc and silicones, in a concentration of from 0.1 to 5, preferably 0.1 to 3, % of the total weight of the mixture.

Flowability agents such as animal or vegetable fats, especially in hydrogenated form and those which are solid at room temperature. These fats preferably have a melting point of 50° C. or above. Triglycerides of $C_{12}$, $C_{14}$, $C_{16}$ and $C_{18}$ fatty acids are preferred. It is also possible to use waxes such as carnauba wax. These fats and waxes may be admixed advantageously alone or together with mono- and/ or diglycerides or phosphatides, especially lecithin. The mono- and diglycerides are preferably derived from the abovementioned fatty acid types. The total amount of fats, waxes, mono-, diglycerides and/or lecithins is from 0.1 to 30, preferably 0.1 to 5, % of the total weight of the composition for the particular layer;

dyes such as azo dyes, organic or inorganic pigments or dyes of natural origin, with preference for inorganic pigments in a concentration of from 0.001 to 10, preferably 0.5 to 3, % of the total weight of the mixture;

stabilizers such as antioxidants, light stabilizers, hydroperoxide destroyers, radical scavengers, stabilizers against microbial attack.

It is also possible to add wetting agents, preservatives, disintegrants, adsorbents, release agents and blowing agents (cf., for example, H. Sucker et al., Pharmazeutische Technologie, Thierne-Verlag, Stuttgart 1978).

Auxiliaries include for the purpose of the invention substances for producing a solid solution of the active ingredient. Examples of these auxiliaries are pentaerythritol and pentaerythritol tetraacetate, polymers such as polyethylene oxide and polypropylene oxide and their block copolymers (poloxamers), phosphatides such as lecithin, homo- and copolymers of vinylpyrrolidone, surfactants such as polyoxyethylene 40 stearate, and citric and succinic acids, bile acids, sterols and others as indicated, for example, in J. L. Ford, Pharm. Acta Helv. 61 (1986) pp.69–88.

Pharmaceutical auxiliaries are also regarded as being additions of bases and acids to control the solubility of an active ingredient (see, for example, K. Thoma et al., Pharm. Ind. 51 (1989) 98–101).

The only precondition for the suitability of auxiliaries is adequate temperature stability.

Active ingredients mean for the purpose of the invention all substances with a pharmaceutical effect and minimal side effects as long as they do not decompose under the processing conditions. The amount of active ingredient per dose unit and the concentration may vary within wide limits depending on the activity and the release rate. The only condition is that they suffice to achieve the desired effect. Thus, the concentration of active ingredient can be in the range from 0.1 to 95, preferably from 20 to 80, in particular 30 to 70, % by weight. It is also possible to employ active ingredient combinations. Active ingredients for the purpose of the invention also include vitamins and minerals, as well as plant treatment agents and insecticides. The vitamins include the vitamins of the A group, the B group, which are meant besides $B_1$, $B_2$, $B_6$ and $B_{12}$ and nicotinic acid and nicotinamide to include also compounds with vitamin B properties such as adenine, choline, pantothenic acid, biotin, adenylic acid, folic acid, orotic acid, pangamic acid, carnitine, p-aminobenzoic acid, myo-inositol and lipoic acid, and vitamin C, vitamins of the D group, E group, F group, H group, I and J groups, K group and P group. Active ingredients for the purpose of the invention also include therapeutic peptides.

The process according to the invention is suitable, for example, for processing the following active ingredients:

acebutolol, acetylcysteine, acetylsalicylic acid, acyclovir, alfacalcidol, allantoin, allopurinol, alprazolam, ambroxol, amikacin, amiloride, aminoacetic acid, amiodarone, amitriptyline, amlodipine, amoxicillin, ampicillin, ascorbic acid, aspartame, astemizole, atenolol, beclomethasone, benserazide, benzalkoniumhydrochloride, benzocaine, benzoic acid, betamethasone, bezafibrate, biotin, biperiden, bisoprolol, bromazepam, bromhexine, bromocriptine, budesonide, bufexamac, buflomedil, buspirone, caffeine, camphor, captopril, carbamazepine, carbidopa, carboplatin, cefachlor, cefadroxil, cefalexin, cefazolin, cefixime, cefotaxime, ceftazidime, ceftriaxone, cefuroxime, chloramphenicol, chlorhexidine, chlor-pheniramine, chlortalidone, choline, cyclosporin, cilastatin, cimetidine, ciprofloxacin, cisapride, cisplatin, clarithromycin, clavulanic acid, clomipramine, clonazepam, clonidine, clotrimazole, codeine, cholestyramine, cromoglycic acid, cyanocobalamin, cyproterone, desogestrel, dexamethasone, dexpanthenol, dextromethorphan, dextropropoxiphene, diazepam, diclofenac, digoxin, dihydrocodeine, dihydroergotamine, dihydroergotoxin, diltiazem, diphenhydramine, dipyridamole, dipyrone, disopyramide, domperidone, dopamine, doxocyclin, enalapril, ephedrine, epinephrine, ergocalciferol, ergotamine, erythromycin, estradiol, ethinylestradiol, etoposide, Eucalyptus globulus, famotidine, felodipine, fenofibrate, fenoterol, fentanyl, flavin-mononucleotide, fluconazole, flunarizine, fluorouracil, fluoxetine, flurbiprofen, folinic acid, furosemide, gallopamil, gemfibrozil, gentamicin, *Gingko biloba*, glibenclamide, glipizide, clozapine, glycyrrhiza glabra, griseofulvin, guaifenesin, haloperidol, heparin, hyaluronic acid, hydrochlorothiazide, hydrocodone, hydrocortisone, hydromorphone, ipratropium-hydroxide, ibuprofen, imipenem, indomethacin, iohexol, iopamidol, isosorbide-dinitrate, isosorbide-mononitrate, isotretinoin, ketotifen, ketoconazole, ketoprofen, ketorolac, labetalol, lactulose, lecithin, levocarnitine, levodopa, levoglutamide, levonorgestrel, levothyroxine, lidocaine, lipase, imipramine, lisinopril, loperamide, lorazepam, lovastatin, medroxyprogesterone, menthol, methotrexate, methyldopa, methylprednisolone, metoclopramide, metoprolol, miconazole, midazolam, minocycline, minoxidil, misoprostol, morphine, multivitamin mixtures or combinations and mineral salts, N-methylephedrine, naftidrofuryl, naproxen, neomycin, nicardipine, nicergoline, nicotinamide, nicotine, nicotinic acid, nifedipine, nimodipine, nitrazepam, nitrendipine, nizatidine, norethisterone, norfloxacin, norgestrel, nortriptyline, nystatin, ofloxacin, omeprazole, ondansetron, pancreatin, panthenol, pantothenic acid, paracetamol, penicillin G, penicillin V, pentoxifylline, phenobarbital, phenoxymethylpenicillin, phenylephrine, phenylpropanolamine, phenytoin, piroxicam, polymyxin B, povidone-iodine, pravastatin, prazepam, prazosin, prednisolone, prednisone, propafenone, propranolol, proxyphylline, pseudoephedrine, pyridoxine, quinidine, ramipril, ranitidine, reserpine, retinol, riboflavin, rifampicin, rutoside, saccharin, salbutamol, salcatonin, salicylic acid, selegiline, simvastatin, somatropin, sotalol, spironolactone, sucralfate, sulbactam, sulfamethoxazole, sulfasalazine, sulpiride, tamoxifen, tegafur, teprenone, terazosin, terbutaline, terfenadine, tetracycline, theophylline, thiamine, ticlopidine, timolol, tranexamic acid, tretinoin, triamcinolone-acetonide, triamterene, trimethoprim, troxerutin, uracil, valproic acid, vancomycin, verapamil, vitamin E, zidovudine.

Preferred active ingredients are ibuprofen (as racemate, enantiomer or enriched enantiomer), ketoprofen, flurbiprofen, acetylsalicylic acid, verapamil, paracetamol, nifedipine or captopril.

It is possible in particular for solid solutions to be formed. The term "solid solutions" is familiar to the skilled worker, for example from the literature cited at the outset. In solid solutions of active pharmaceutical ingredients in polymers, the active ingredient is in the form of a molecular dispersion in the polymer.

The resulting mixture is preferably solvent-free, i.e. it contains neither water nor an organic solvent. The resulting mixture is subsequently introduced into a molding calender discussed above.

The solid pharmaceutical forms which can be produced using the process according to the invention can finally also be provided in a conventional way with film coatings which control the release of active ingredient or mask the taste. Suitable materials for such coatings are polyacrylates such as the Eudragit types, cellulose esters such as the hydroxypropylmethylcellulose phthalates, and cellulose ethers such as ethylcellulose, hydroxypropylmethylcellulose or hydroxypropylcellulose.

It is thus possible with the process according to the invention to produce drug forms with particularly accurate dimensions. Surprisingly, this process is low-cost, permits very large numbers of item per unit time to be achieved and avoids all waste.

The figures illustrate the invention without limiting it. FIGS. 1 to 3 are briefly described below.

Figure 1:
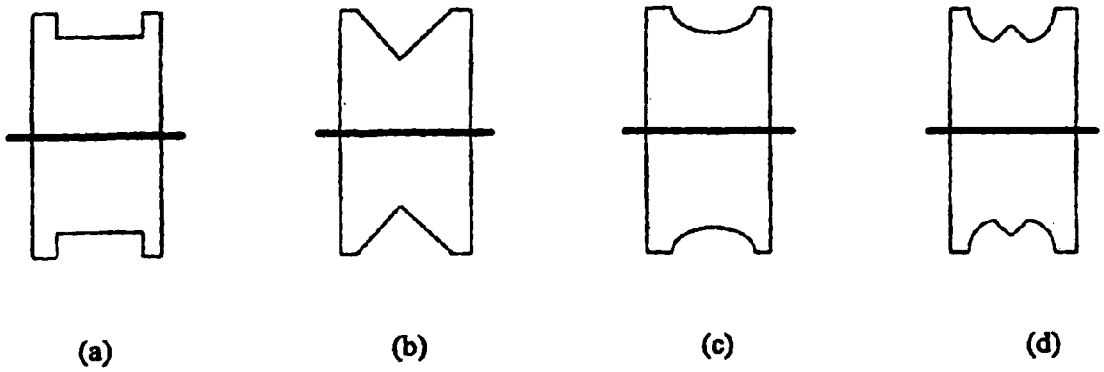
FIG. 1 shows various designs of the annular groove present according to the invention in a roll.

FIG. 1 depicts various designs of the annular groove in cross-section. The annular groove may have a rectangular (a), triangular (b) or rounded (c) cross-section profile. A circulating bar may be present on the base of the annular groove (d), leading to solid dosage forms having a score on one side of their surface.

Figure 2:
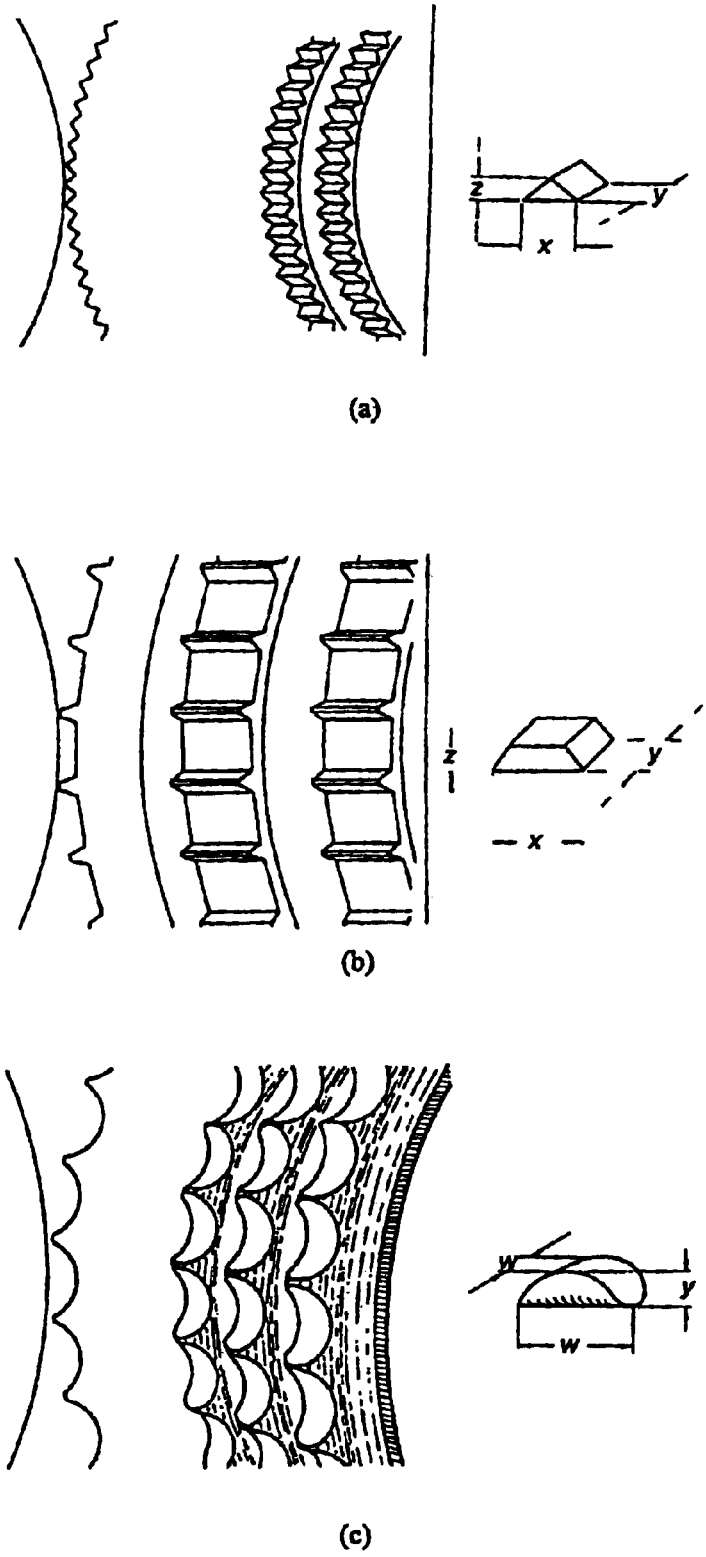
FIG. 2 shows various designs of the interstices between consecutive teeth in a ring of teeth present according to the invention on a roll, and the dosage forms obtainable therewith.

FIG. 2 shows the dosage forms which can be obtained depending on the design of the interstices between consecutive teeth in a ring and having a prism shape (a), truncated prism shape (b) or saddle shape (c).

Figure 3:
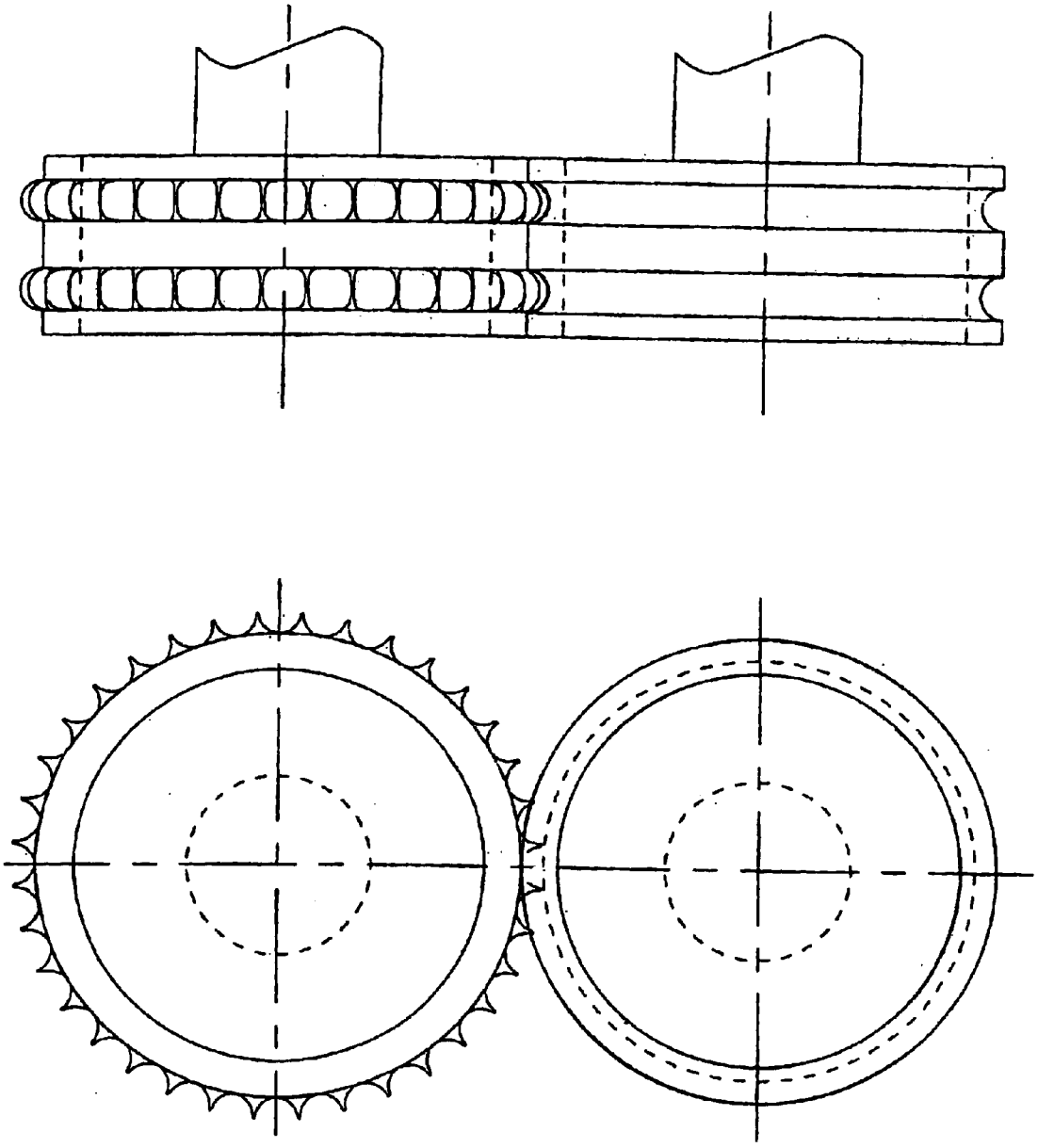
FIG. 3 shows the design principle of a pair of rolls to be used according to the invention by means of a specific example.

FIG. 3 illustrates the design principle of a pair of rolls with two lanes, one roll having two circulating annular grooves with rounded cross-section profile, and the other roll having two circulating rings of teeth which extend radially outward, with the interstices between consecutive teeth having a rounded longitudinal profile. FIG. 3 shows at the top a cross-section of the pair of rolls through the axes of the rolls. FIG. 3 shows at the bottom a cross-section of the pair of rolls perpendicular to the axes of the rolls.

What is claimed is:

1. A process for producing solid dosage forms by a) producing a plastic mixture which comprises at least one active ingredient and at least one polymeric binder, and b) shaping the plastic mixture to the solid dosage forms in a molding calender with two counterrotating molding rolls, wherein one molding roll has at least one annular groove running along its periphery and the other molding roll has at least one ring, running along its periphery, of teeth extending radially outward and able to engage in the annular groove.

2. A process as claimed in claim 1, wherein the annular groove has a rounded cross-section profile.

3. A process as claimed in claim 1, wherein the interstices between consecutive teeth in a ring have a rounded longitudinal profile.

4. A process as claimed in claim 1, wherein a circulating bar is present on the base of the annular groove, and the teeth have a corresponding recess.

5. A process as claimed in claim 1, wherein the resulting dosage forms are deflashed.

6. The process of claim 1, wherein the plastic mixture is a melt comprising at least one pharmaceutically active ingredient, at least one pharmacologically acceptable polymeric binder, and optionally one or more conventional pharmaceutical additives.

7. The process of claim 1, wherein the plastic mixture has a pasty to viscous consistency.

* * * * *